US006134993A

United States Patent [19]

Tally

[11] Patent Number: 6,134,993

[45] Date of Patent: Oct. 24, 2000

[54] PLIERS WITH ADJUSTABLE JAWS

[75] Inventor: Kevin L. Tally, Clarinda, Iowa

[73] Assignee: Lisle Corporation, Clarinda, Iowa

[21] Appl. No.: 09/172,359

[22] Filed: Oct. 14, 1998

[51] Int. Cl.[7] ..... B25B 7/04

[52] U.S. Cl. ..... 81/394; 81/392

[58] Field of Search ..... 81/394, 385, 386, 81/387, 391, 392, 405

[56] References Cited

U.S. PATENT DOCUMENTS

| | | | |
|---|---|---|---|
| 139,520 | 6/1873 | Rigg | 81/392 |
| 638,378 | 12/1899 | Casterlin | 81/394 |
| 2,325,035 | 7/1943 | Cargile | 81/387 |
| 5,203,241 | 4/1993 | Mattis | 81/424 |
| 6,006,633 | 12/1999 | Kaiser et al. | 81/387 |

FOREIGN PATENT DOCUMENTS

| | | | |
|---|---|---|---|
| 926212 | 9/1947 | France | 81/387 |
| 3824451A | 1/1990 | Germany | 81/387 |

*Primary Examiner*—James G. Smith
*Assistant Examiner*—Hadi Shakeri
*Attorney, Agent, or Firm*—Banner & Witcoff, Ltd.

[57] ABSTRACT

A pliers with adjustable jaws permits alignment of the jaws in various orientations with respect to the handles. The pliers includes an internal spring which maintains the jaws normally in the open position. Detent balls, in combination with the spring enable movement of the jaws simultaneously and equally between detent positions to adjust the orientation of the jaws with respect to the handles.

7 Claims, 6 Drawing Sheets

FIG.1
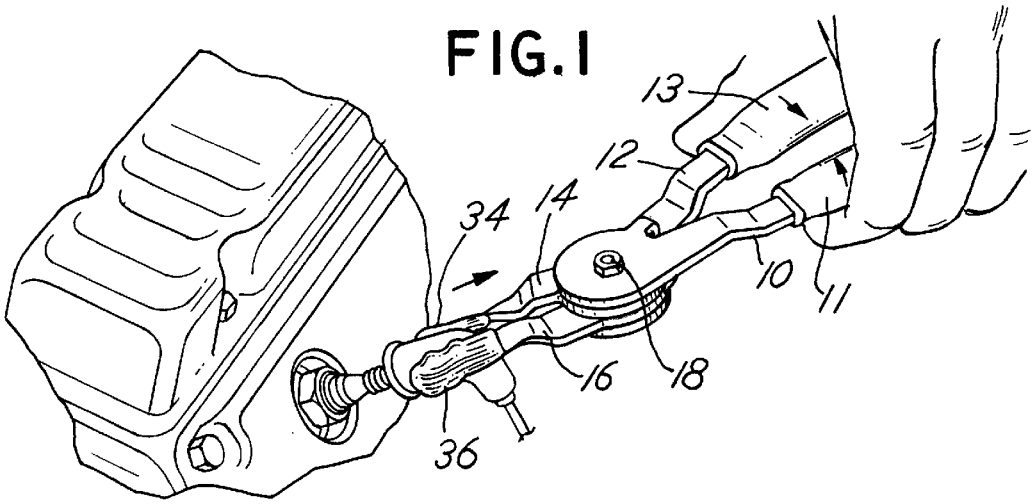
FIG.3 FIG.4
FIG.2
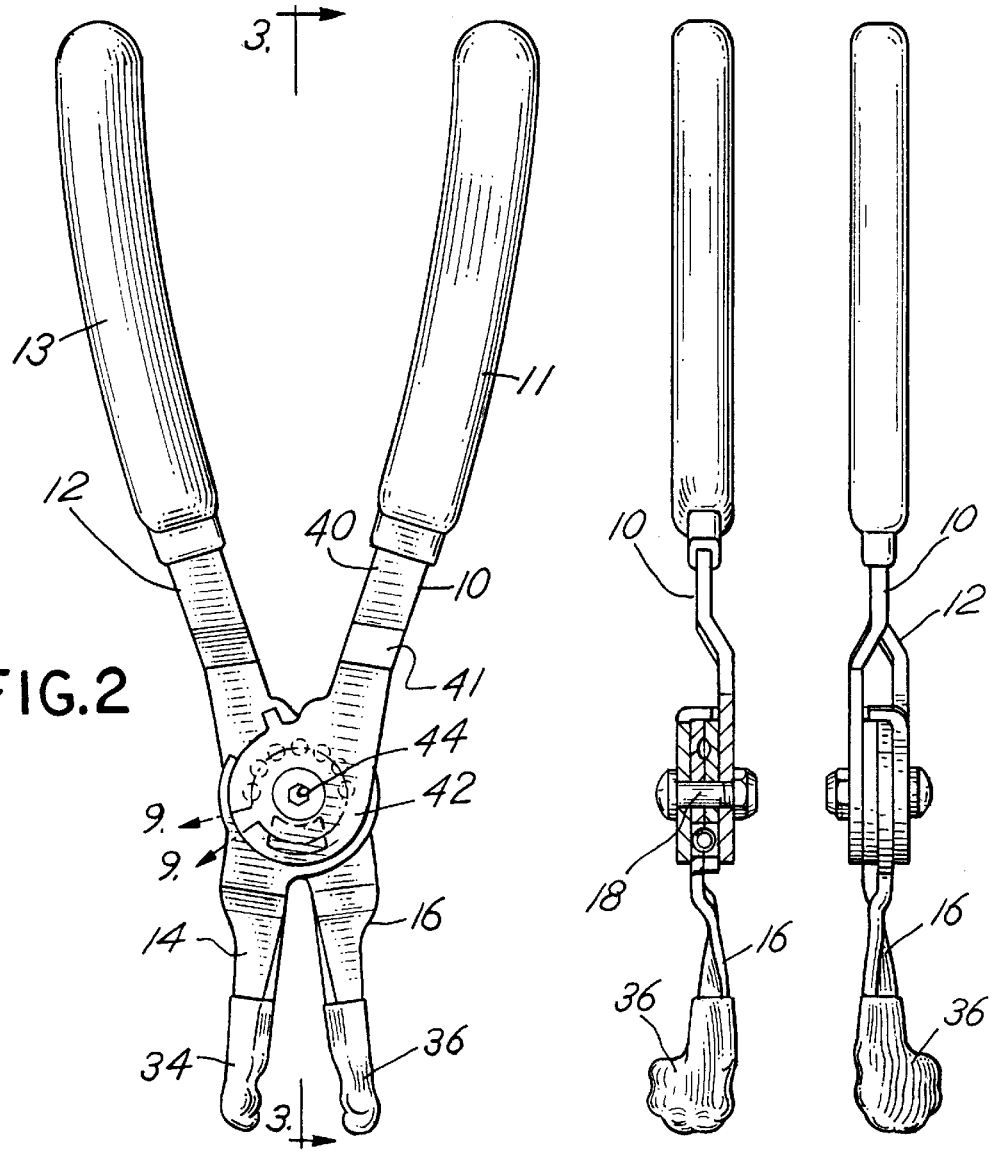

FIG.9
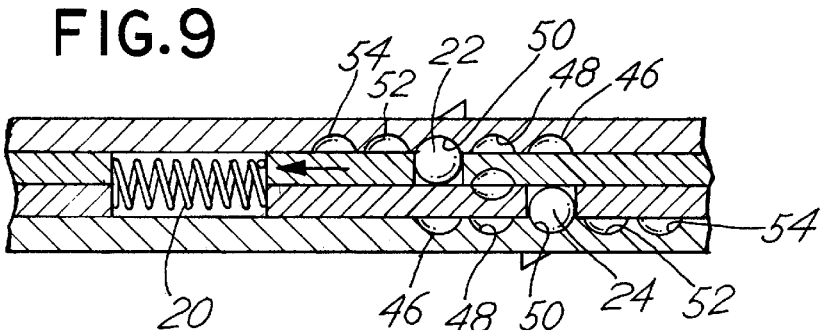
FIG.10
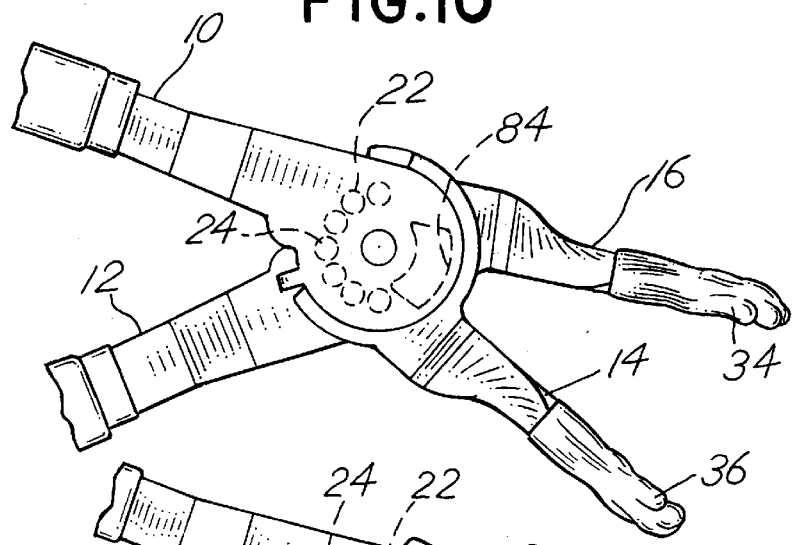
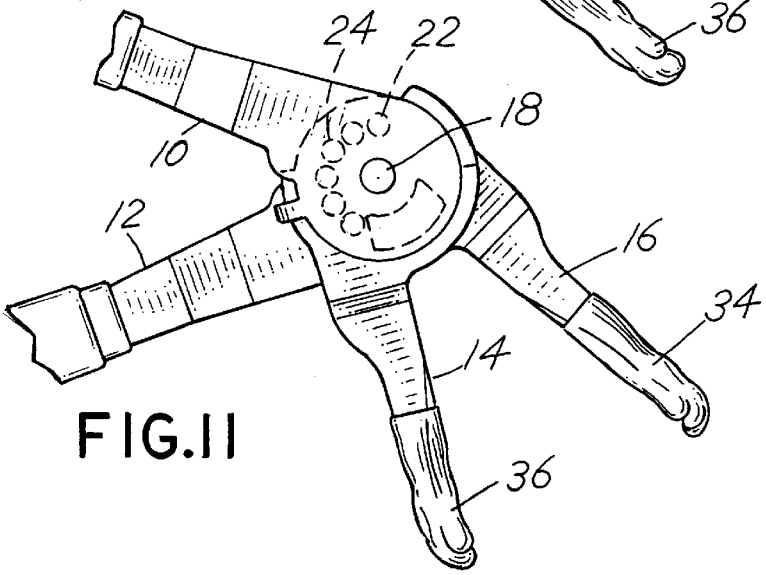
FIG.11

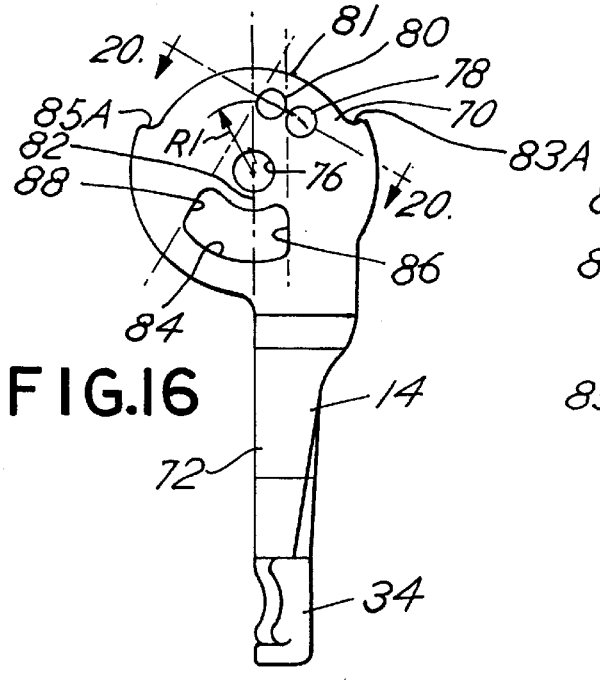
FIG.16
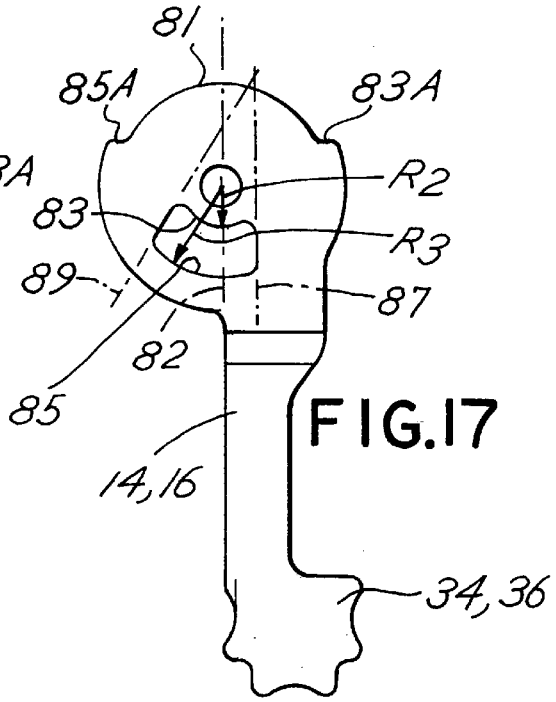
FIG.17
FIG.20
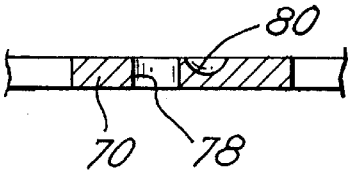
FIG.18
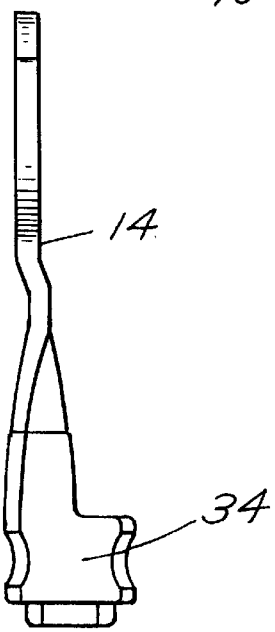
FIG.19
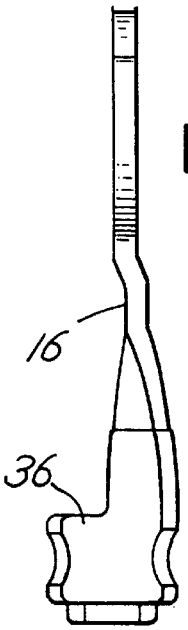

PLIERS WITH ADJUSTABLE JAWS

BACKGROUND OF THE INVENTION

In the principal aspect, the present invention relates to a pliers construction having first and second manually operable handles pivotally connected to first and second jaws, respectively, wherein alignment of a respective jaw with respect to an associated handle is adjustable.

When servicing a vehicle such as an automobile and, more particularly, when servicing an internal combustion engine of a vehicle, it is often necessary to remove the spark plug wire attached to each spark plug. Typically, the plug wire includes an end connector which fits onto the plug and an insulating boot which fits over the connector of the plug lead wire to the contact end of the plug. The boot protects the plug from corrosion and also provides insulation around the plug contact to prevent inadvertent shock or grounding, for example. When servicing a vehicle, and more particularly when attempting to change spark plugs, it is necessary to effectively and efficiently remove the protective boot from the plug and additionally remove the lead wire connected by the connector to the plug. Often this is accomplished by use of a pliers designed to grip the boot and simultaneously or independently grip the lead wire connector. The gripped boot and/or connector may thus be retracted or removed from the contact end of the plug by use of such a pliers.

Various internal combustion engine designs provide various and unique positioning of spark plugs and the lead wires connected to the plugs. Consequently, using a standard pliers having jaws aligned with the handles will not necessarily enable a mechanic or service person to effectively reach and grip a spark plug boot or the lead wire connector which is connected to a spark plug. As a result, it is desirable to have a pliers construction which enables the service person or mechanic to adjust the orientation of the jaws relative to the handles of the pliers. In this manner, the jaws may be appropriately adjusted to thereby enable the mechanic to reach into very tightly constrained or difficult-to-reach positions. The foregoing need, among others, inspired the development of the present invention.

SUMMARY OF THE INVENTION

Briefly, the present invention comprises a pliers having jaws which are pivotally adjustable with respect to the handles of the pliers. Thus the jaws may be oriented in various directions relative to the handles. The handles as well as the jaws each include a hub with a center pivot. The hubs are all pivotally connected by a single pivot pin through the center pivot. The hubs each include an array of detents radially spaced from the pivot axis of the hubs for receipt of a detent ball retained in a passage in the jaw hubs. The jaw hubs further include a biasing member positioned between the separate jaw hubs to bias the two jaws apart and to also maintain each jaw in a locked engagement position with its respective handle. Rotation of ajaw hub with respect to a non-respective handle hub effects a release of the interlocking detent balls which normally maintain the respective jaws and handles in a fixed, connected position or orientation. Upon such release, both jaws may be rotated relative to their respective handles into a distinct and different orientation or alignment. In a preferred embodiment, the jaws are aligned with the handles in a center position as well as two positions on opposite sides of the center position representing a total of five separate positions or orientations of the jaws relative to the handles of the pliers.

Thus it is an object of the invention to provide an improved pliers of the type which may be used as a spark plug boot puller by mechanics servicing an internal combustion engine.

Another object of the invention is to provide an improved pliers construction wherein the jaws of the pliers comprise separate elements relative to the handles and wherein those separate jaw elements are adjustable with respect to their orientation to the handles.

Yet another object of the invention is to provide an improved pliers construction having first and second jaws adjustable in orientation with respect to first and second handles respectively by manually rotating the jaws relative to the handles to thereby manually disengage a detent mechanism which normally, rigidly connects a respective jaw to a respective handle.

Another object of the invention is to provide an improved pliers construction which has a jaw adjustment feature wherein the pliers may be fabricated for various tasks including, by way of example, to repair and service vehicles or for medical or dental procedures.

Another object of the invention is to provide an adjustable pliers construction wherein the orientation of the jaws of the pliers relative to the handles may be easily adjusted with a minimum of mechanical knowledge required in order to effect the adjustment.

Another object of the invention is to provide an improved pliers construction including adjustable jaws which is economical to manufacture, rugged, useful for many purposes and which is reasonably priced for use by consumers.

These and other objects, advantages and features of the invention will be set forth in the detailed description which follows.

BRIEF DESCRIPTION OF THE DRAWING

In the detailed description which follows, reference will be made to the drawing, comprised of the following figures:

FIG. 1 is an isometric view of the pliers of the invention in use;

FIG. 2 is a top plan view of the pliers of the invention;

FIG. 3 is a cross section of FIG. 2 along the line 3—3;

FIG. 4 is a side elevation of the pliers of FIG. 1;

FIG. 9 is a cross section of FIG. 2 along the line 9—9;

FIG. 10 is a top partial plan view of the pliers of FIG. 2 wherein the jaws are fully moved to the first, different orientation;

FIG. 11 is a top partial plan view of the pliers of FIG. 2 wherein the jaws have been positioned in a second, distinct orientation;

FIG. 16 is a plan view of a left jaw of the pliers of the invention;

FIG. 17 is a plan view of a jaw blank for the jaw of FIG. 16;

FIG. 18 is a side elevation of the jaw of FIG. 16;

FIG. 19 is a side elevation of the right jaw of the pliers of the invention; and FIG. 20 is a cross section of FIG. 16 along the line 20—20.

DESCRIPTION OF THE PREFERRED EMBODIMENT

Figure 5:
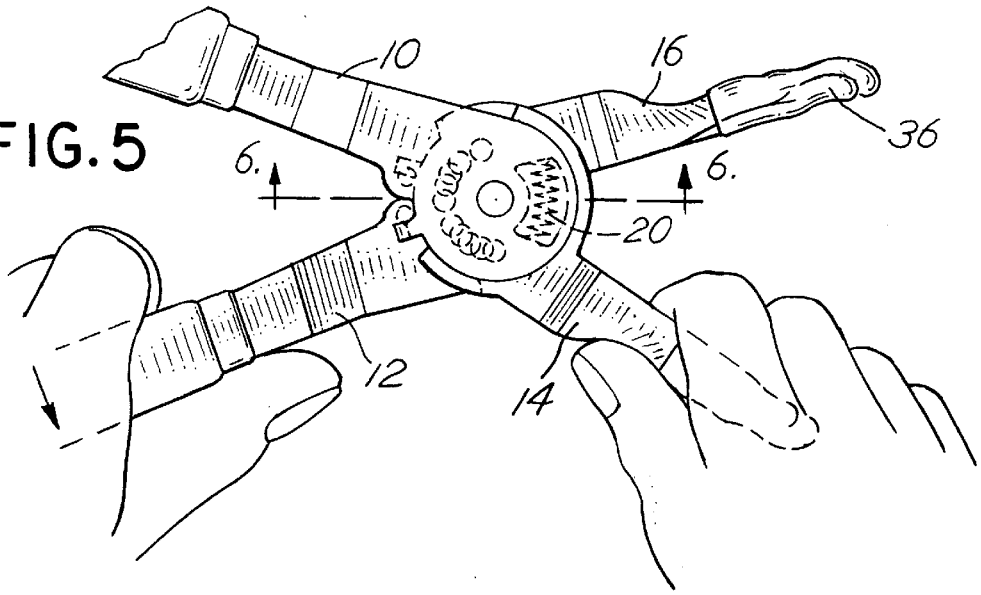
FIG. 5 is a top partial plan view of the pliers of FIG. 2 wherein the jaws are partially manually moved to a first, different orientation.
Figure 6:
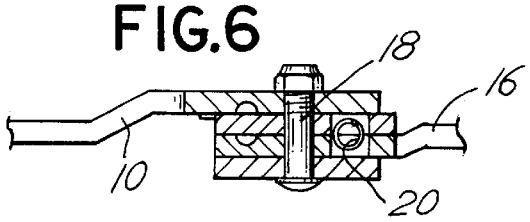
FIG. 6 is a cross section of FIG. 5 along the line 6—6.
Figure 7:
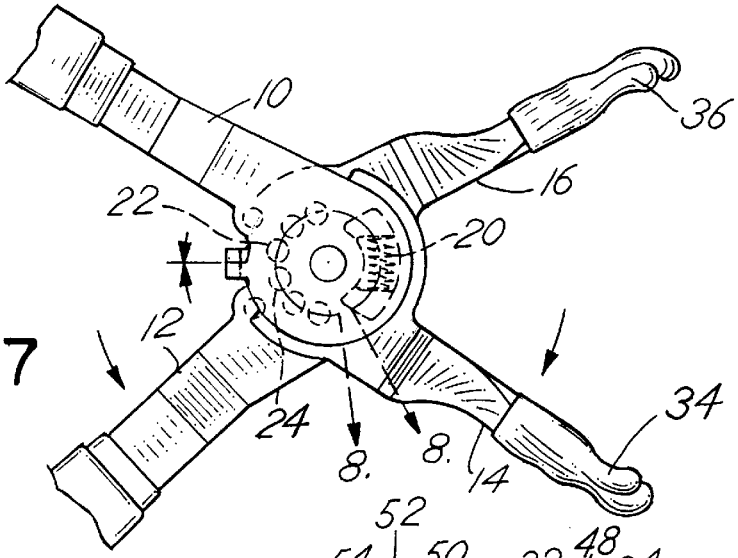
FIG. 7 is a top partial plan view of the pliers of FIG. 2 showing the position of jaws and handles as handle stops first come in contact.
Figure 8:
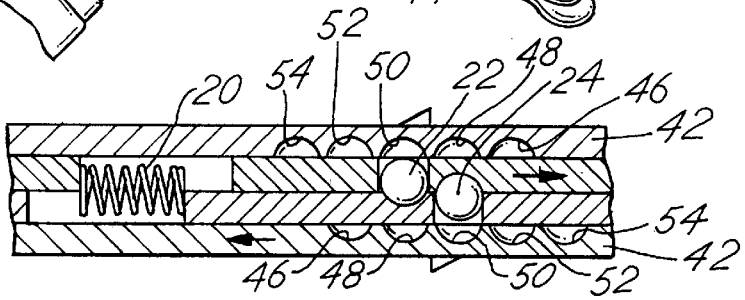
FIG. 8 is a cross section of FIG. 7 along the line 8—8.

Referring to FIGS. 1, 2, 3 and 4, the improved pliers of the invention is comprised of a first handle 10, a second handle 12, a first or left jaw 14 and a second or right jaw 16. The handles 10, 12 and jaws 14, 16 are connected together by a bolt or pivot pin 18. Further component parts of the pliers include a spring 20, a first detent ball 22 and a second detent ball 24.

GENERAL DESCRIPTION OF OPERATION OF THE PLIERS

In order to appreciate the construction of the pliers of the invention, there is provided a general description of its operation. This is followed by a specific discussion of the component parts of the pliers. This, in turn, is followed by a specific description of the operation of the pliers.

Referring to FIG. 1, the first handle 10 and the second handle 12 are covered respectively with a vinyl grip 11 and 13. The handles 10 and 12 may be manually gripped and thereby moved toward one another in the direction of the arrows in FIG. 1. Movement of the first handle 10 will effect a simultaneous movement of the connected, respective first jaw 14 toward the second jaw 16. Movement of the second handle 12 will effect movement of the respective, connected second jaw 16 toward the first jaw 14. These component handles 10, 12 and jaws 14, 16 move about or pivot about a pivot axis defined by the pivot bolt or pin 18. During normal operation, the first handle 10 and second handle 12 will be rigidly attached to or connected with, respectively, the first jaw 14 and the second jaw 16. Thus handle 10 and jaw 14 as well as handle 12 and jaw 16 are connected together and move in unison. In the orientation depicted in FIG. 2, the first jaw 14 and first handle 10 are generally aligned in a uniform or straight line. In similar fashion, the second handle 12 and second jaw 16 are aligned in a straight line.

The jaws 14 and 16 include gripping elements or gripping ends 34 and 36, respectively, which may be vinyl coated and which are formed to fit about a spark plug boot, for example, in order to clamp on and grip the boot for removal from a spark plug. The clamping action, of course, is effected by manually closing the jaws 14 and 16 in response to manual closure of the handles 10 and 12.

Often it is difficult to position the gripping ends 34 and 36 about a spark plug boot when the jaws 14 and 16 are aligned in the manner depicted in FIG. 2. Thus it becomes desirable to move the jaws 14 and 16 relative to the handles 10 and 12 to a position, for example, such as depicted in FIG. 10 or FIG. 11. Movement of the jaws 14 and 16 to the position of FIG. 10 may be effected, for example, by manually gripping the first jaw 14 and the second handle 12 and pivoting those elements toward one another as shown in FIG. 5 to the position illustrated in FIG. 10. Simultaneous with the described pivoting motion, the pliers construction of the invention is constructed so that the second jaw 16 will also move and be transported by movement of the first jaw 14 to maintain the spacing between the jaws 14 and 16 and the relative angular relationship therebetween. The movement of the first jaw 14 and second handle 12 in the manner described is accomplished in an incremental, fixed step of movement controlled by a detent mechanism, described in greater detail below. The movement may be further effected to a second detent position illustrated by FIG. 11. Again, the first jaw 14 and second handle 12 are gripped and moved toward one another about the pivot pin or bolt 18. Again, the second jaw 16 will trail behind and will ultimately maintain a fixed jaw opening as depicted in FIG. 11, identical to the magnitude of the jaw opening depicted in FIG. 2 and FIG. 10.

The movement of the jaws 14, 16 may be reversed by gripping the second jaw 16 and first handle 10 and pivoting those elements 10, 16 toward one another about the pin or bolt 18. Thus, the jaws 14, 16, when in the position illustrated in FIG. 11, may be rotated or pivoted back to the position illustrated in FIG. 10 and FIG. 2. They may be further pivoted to another first or second detent position. In other words, the second jaw 16 may be rotated in the counter-clockwise direction in FIG. 10 or 11 as the first handle 10 is rotated in the clockwise direction to assume a further first or second detent position by pulling in the direction indicated by the arrows in FIGS. 10 and 11. The jaws 14 and 16 may thus be oriented in any one of five distinct positions relative to the handles 10 and 12. Thereby the jaws 14, 16 may be oriented in a manner which will make them most effective and efficient with respect to their utility for removing a spark plug boot, for example.

However, there are many other uses which a pliers mechanism of this type may serve, for example, for dental or medical purposes. Thus the pliers construction of the present invention is not limited merely to utilization as a spark plug boot removal tool. Moreover, there is depicted a series of five separate positions of the jaws 14, 16 relative to the handles 10, 12 wherein the jaws 14, 16 are moved in thirty degree (30°) increments. The incremental movement between the detent positions may, however, be adjusted in any manner desired. For example, the incremental movements may each be more or less than thirty degrees (30°). Incremental movements may be equal or non-equal. More than or less than five separate detent positions may be provided. This description, however, relates to a preferred embodiment in the context of a spark plug boot puller or removal tool having five positions.

It is noted that the handles 10 and 12 and jaws 14, 16 are spring biased apart. Consequently, manual release of the handles 10, 12 will permit a spring element within the jaw hubs to cause the handles 10, 12 and thus the jaws 14, 16 to separate. The handles 10, 12 and jaws 14, 16 are thus spring biased to an open position. Additionally, the handles 10 and 12 include stops, described in greater detail below, which preclude them from being opened or spread beyond a fixed angle. Further, the jaws 14 and 16 include stops which engage with lugs on the handles 10, 12 to preclude movement of the jaws 14 and 16 about pin 18 beyond a fixed limit. Again, this will be described in greater detail below.

DESCRIPTION OF THE COMPONENT PARTS OF THE PLIERS

FIGS. 12–20 illustrate in greater detail the component parts comprising the pliers of the invention. Referring first to FIGS. 12–15, there is illustrated the construction of the handles 10 and 12. The handles 10 and 12 have an identical construction and are merely reversed with respect to each other when assembled with the bolt or pin 18 and jaws 14, 16. Thus the description of the second handle 12 is equally applicable to the first handle 10.

Figure 14:
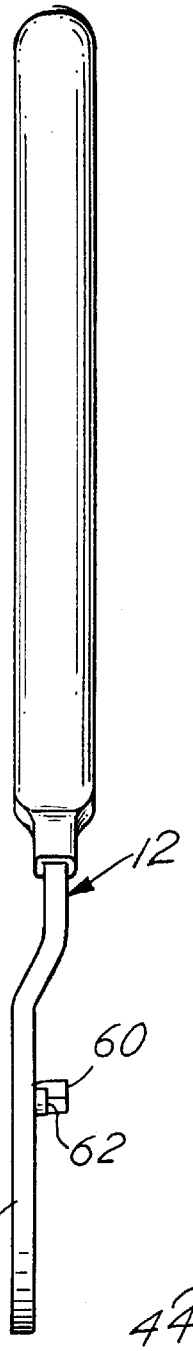
FIG. 14 is a side elevation of the handle of FIG. 4.
Figure 15:
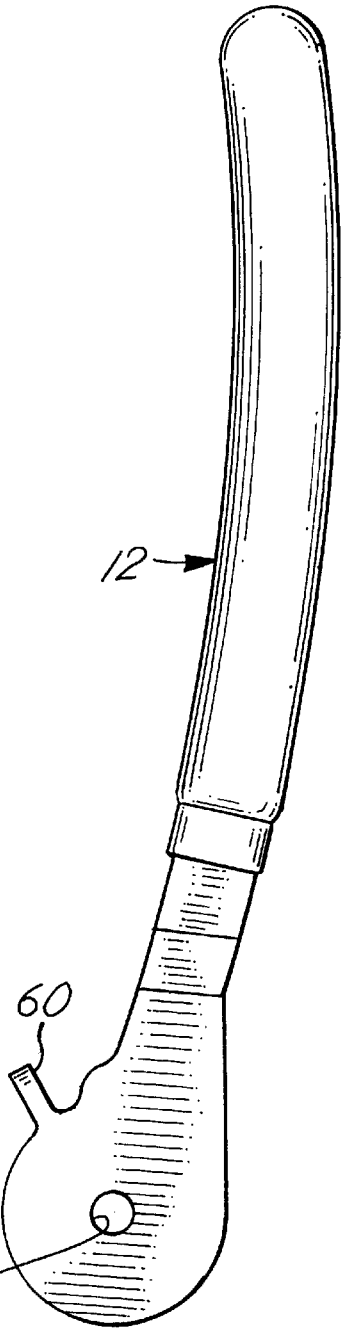
FIG. 15 is a bottom or outside plan view of the handle of FIG. 4.

The second handle 12 is stamped or cut from a flat sheet of steel and includes an arcuate hand grip section 40. The section 40 is connected to a generally circular hub section or hub 42 by a linking section 41. The hub section 42 includes a center opening or passage 44 for receipt of the bolt or pin 18 about which the second handle 12 pivots during its manual operation. The hub section 42 is in a plane which is parallel to, but spaced from, the plane of the section 40 and is connected thereto by the angular linking section 41. FIG. 15 illustrates the back side or opposite side of the second handle 12 from that shown in FIG. 13. FIG. 14 is a side elevation.

Positioned an equal radial distance ($R_1$) from the center of the passage 44 in a hub section 42 are a series of five detent recesses or openings 46, 48, 50, 52 and 54. All of the detent openings 46, 48, 50, 52 and 54 are positioned an equal radial distance $R_1$ from the center of the through passage 44. Each detent 46, 48, 50, 52, 54 is separated from the next adjacent detent by an angle of approximately thirty degrees (30°) along an arc passing through the centers of the adjacent detents 46, 48, 50, 52, 54. Positioned at an angle of 15° between detents 50 and 52 (i.e., midway between the detents 50 and 52) is a lug 60 which serves as a stop to preclude opening the handles 10 and 12 beyond a limited distance when handles 10, 12 are fastened together by the pivot pin 18.

Positioned at a radial distance $R_2$ from the center of the pivot opening 44 is a stop projection or stop 62. The stop projection 62 is intermediate the detents 52 and 54. The stop 62 lies on an arc equi-distant between the detents 52 and 54. As will be described below, the stop 62 interacts with a projection on a hub 70 of the jaws 14 or 16 to limit the movement of the jaws 14, 16 relative to the handles 10, 12.

FIGS. 16–20 relate to the construction and configuration of the jaws 14, 16. FIG. 17 depicts a jaw blank formed from sheet steel by a blanking or cutting process. The jaw blank of FIG. 17 may then be formed into either a first (left) hand jaw 14 or second (right) hand jaw 16 by bending the end portion or clamp 34, 36 of the jaw blank of FIG. 17 to the left or the right.

Referring to FIGS. 16 and 18–20, each jaw 14, 16 comprises a hub 70 with a projecting jaw member 72 terminating with a clamp, such as clamp 34, 36. As can be seen, the clamp 34, 36 is formed by bending the end of the member or section 72 either to the right or to the left to form a first jaw 34 or a second jaw 36.

The construction of the hub section or hub 70 is quite important. The hub section 70 includes a center passage 76. Also a first throughpassage 78 in hub 70 is spaced a distance $R_1$ from the center of the center passage 76. A second detent 80 is spaced the same radial distance, $R_1$, from the center line of the center through passage 76. The first through passage 78 and the detent 80 are on an arc separated 30° from each other along that arc. The first through passage 78 is designed to receive a ball bearing such as ball bearing 24 or ball bearing 22. Note that the detent 80 is on an arc which is spaced 15° from a longitudinal axis 82 in FIG. 16.

A window 84 is defined and cut through the hub 70. The window 84 includes arcuate sides 83, 85 having radii R2, R3, respectively, and opposite sides or edges 86 and 88 which lie on spaced radii 87, 89 defining an arc of about thirty degrees (30°). The center of the arc is on or adjacent one arcuate edge 81 of the hub 70 opposite jaw 14. The side 86 of the window 84 is generally aligned with the vertical axis 82 in FIG. 16 passing through the center of hub 70. As depicted in FIG. 20, the detent 80 extends partially into the plate or hub 70 and first through passage 78 extends totally through the hub 70. Center throughpassage 76 is designed for receipt of the pin or bolt 18.

FIG. 19 illustrates the right jaw 16. FIG. 17 illustrates the blank from which the gripping ends 34, 36 are formed and FIG. 18 is a side elevation of the left jaw 14. Note all of the elements (handles 10, 12, jaws 14, 16) have the same thickness and may be fabricated from flat plates of sheet steel.

DESCRIPTION OF PLIERS OPERATION

Figure 12:
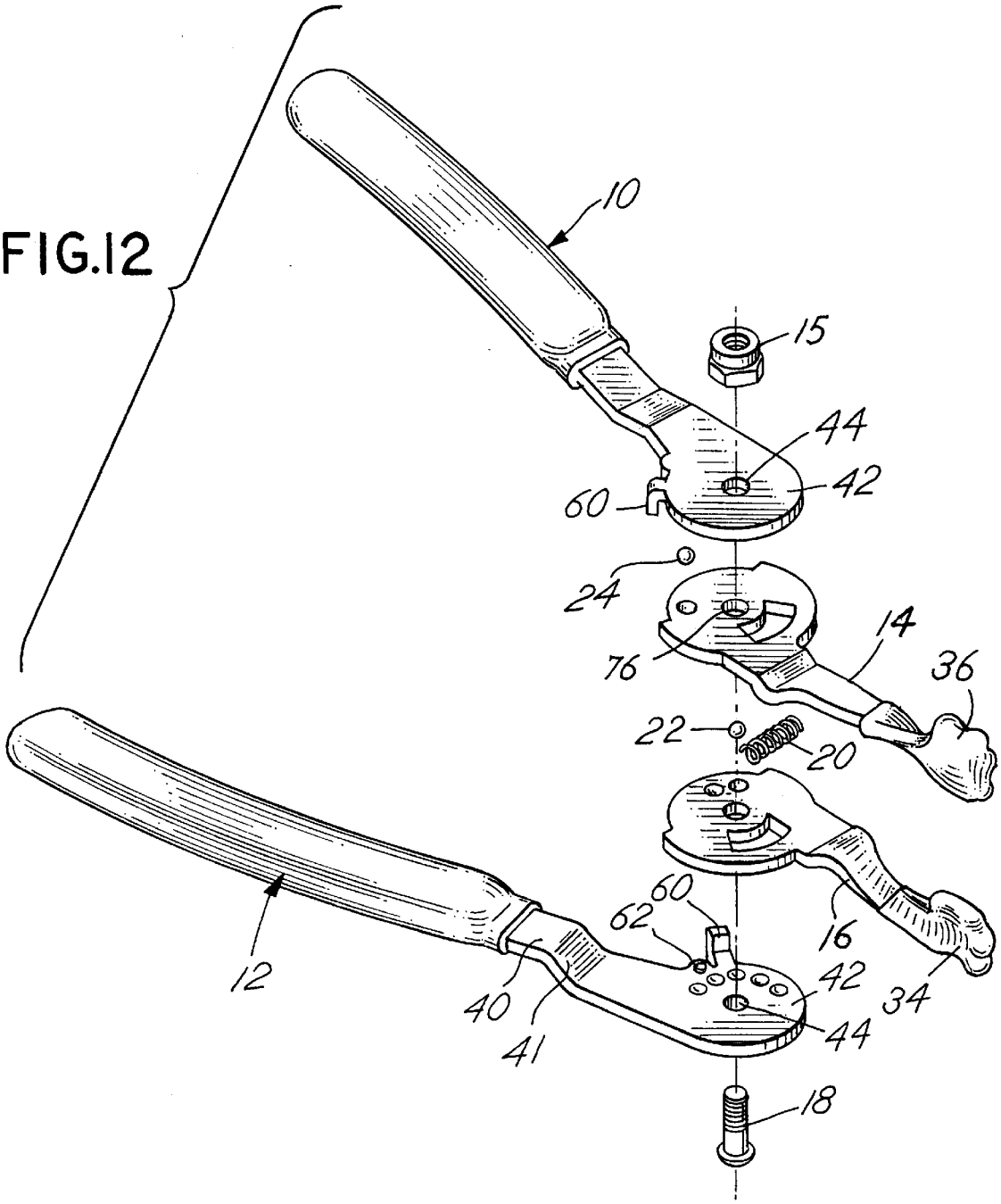
FIG. 12 is an exploded, isometric view of the hub construction for the handles and jaws of the pliers of FIG. 2.
Figure 13:
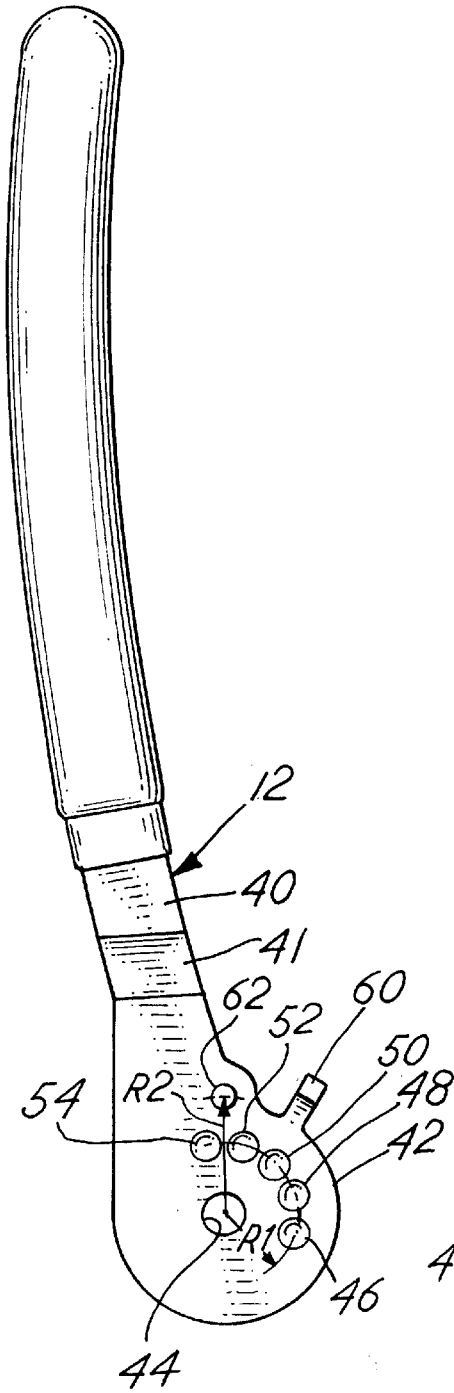
FIG. 13 is a top or inside plan view of the handle of the pliers of the invention.

FIG. 12 illustrates the manner in which the separate components previously described are assembled and the remaining figures illustrate the manner in which the components interact with one another in order to effect a change of the position of the jaws 14, 16 relative to the handles 10, 12. Referring, therefore, to FIG. 12, it will be noted that the bolt 18 fits through the center line passages 44, 76 with the handles 10 and 12 on the outside of the assemblage and the left or first jaw 14 and right or second jaw 16 on the inside. Thus, the second handle 12 with its associated hub 42 is first fitted over the bolt 18. Thereafter, the right or second jaw 16 is fitted over the bolt 18. Thereafter, the left or first jaw 14 is fitted over bolt 18. Finally, the first handle 10 is fitted over the bolt 18 and a lock nut 15 attached to secure the handles 10, 12 and jaws 14, 16 together though they remain pivotal one with respect to the other about the bolt 18.

During the assemblage, the windows 84 are arranged to overlap or be congruent with one another, and a coil spring 20 is fitted simultaneously into both the windows 84 of jaws 14, 16. Normally the spring 20, which is a compressible coil spring, maintains the windows 84 of each jaw 14, 16 in a congruent relationship. Thereby, spring 20 biases the jaws 14 and 16 as well as the handles 10 and 12 apart in spaced relation. The biasing spring 20, in other words, aligns the edges or sides 86, 88 of each window 84 over one another.

The balls 22 and 24 are positioned within respective through passageways 78 of the jaws 14 and 16. Thus a ball 24 fits into the right jaw 16 through passageway 78. The ball 22 fits into the left jaw 14 through passageway 78. The balls 22 and 24 in through passageways 78 have a diameter which exceeds the thickness of each jaw 14, 16 and normally have one side resting against a planar outer surface of hub 70 of the next adjacent jaw 14, 16. As a consequence, an opposite side of each ball 22, 24 extends into one of the detent openings of the related, respective handle 12, 14. Thus the ball 24 will be positioned and project from the through passageway 78 into a detent, e.g. 46, 48, 50, 52 or 54, ofthe handle 12. Similarly, ball 22 will project into a detent, e.g. 54, 52, 50, 48 or 46 of the handle 10.

Note, as shown in FIG. 9, that handles 10, 12 are arranged with their detents or detent openings 46, 48, 50, 52, 54 each opposed, respectively, to one of the jaws 14, 16. The jaws 14, 16 are arranged or spaced by thirty degrees (30°) in their inactivated or rest position. Consequently, the three detents 46, 48, 50 of handle 10 will overlie the three detents 50, 48, 46 of handle 12, e.g., detent 46 of handle 10 overlies detent 50 of handle 12, etc. in the described arrangement. FIG. 9 further illustrates the arrangement wherein the balls 22 and 24 are biased by the planar flat surface of the next adjacent hub of a jaw 14 or 16 into a detent 46, 48, 50, 52 or 54 in the handles 10 or 12. The handles 10 and 12 may then be gripped and manually moved in opposition to the force of spring 20 and thus closed to thereby close the jaws 14 and 16 as previously described and depicted in FIG. 1. Since the balls 22 and 24 lock related first handle 10 and first jaw 14 as well as related or respective second handle 12 and second jaw 16 together, the handles 10, 12 and jaws 14, 16 move in unison. Closure is limited by the engagement of jaw members 72 of the two jaws 14, 16 which are in the same plane due to the bending of ends 34, 36. Similarly the sections 40 of each handle 10, 12 are in the same plane due to the connecting bend section 41.

In order to realign or re-orient the jaws 14, 16 relative to the handles 10, 12, the first jaw 14, for example, is gripped and moved clockwise in FIG. 5 toward the second handle 12. This causes the spring 20 to be compressed by engagement of the sides 86, 88 of the window 84 against the spring 20. When so compressed against the force of the spring 20, the first jaw 14 will move the passage 78 into alignment with the detent 80 in the hub of the second jaw 16. This permits the ball 24 to move into the passage 78 and release from the detent, e.g. detent 50, associated with the first handle 10. The first jaw 14 may then be further rotated to move the ball 24 into alignment with the next adjacent detent 48 of first handle 10. Simultaneously, the window 84 and, more particularly, the spring 20 in the window 84 tends to pull the adjacent second jaw 16 along with it so that the jaws 14, 16 will move simultaneously in the same direction (clockwise or counter-clockwise).

The alignment of the through passages 78 with the next adjacent detent in the handle 10 or 12 is followed by release of manual manipulation of the jaws 14, 16 for purposes of reorientation. Upon such release, the spring 20 will cause the windows 84 to become realigned thereby forcing the balls 22, 24 upward into the next adjacent detent 48 or 52 of the appropriate handle 10, 12. With the construction it is possible to move the balls 22, 24 associated with the respective jaws 14, 16 between any of five different positions in the embodiments shown.

In order to prevent undesired extraneous movement of the jaws 14, 16 beyond the limit of all the handle detents 46, 48, 50, 52, 54, stops 83A, 85A are provided on the outer rim of each jaw hub 70 to engage lug 62 on the handle 10, 12. This limits the rotational movement of the jaws 14, 16 and thereby prevents the balls 22 and 24 from becoming moved to a position which will preclude operation of the pliers. Lugs 60 projecting from the handles 10, 12 preclude movement of the handles 10, 12 beyond a fixed limit when they are separated one from the other.

It is possible to vary the construction of the pliers by providing a different number of detents by altering the shape and size of the window 84, and by various other means. Additionally, the thickness of the hubs 70 plays a role in the construction of the invention. Thus rather than utilizing a through passage 78, the thicknesses of the detents in the hubs and ball size may be adjusted in order to prevent the movement and engagement of the jaws 14, 16 independently from one another. The embodiment of the invention, however, is directed to an arrangement wherein the jaws 14, 16 move substantially simultaneously and together because the thicknesses of each of the elements is substantially equal and thus the jaws 14, 16 may be moved in equal and opposite directions and simultaneously. The amount of movement of the jaws 14, 16 is, in the embodiment described, thirty degrees (30°). However, other angular movements may be provided. Additionally, the incremental angular movements may be varied and need not be uniform between each of the detent positions. Thus while there has been set forth a preferred embodiment of the invention, it is to be understood that the invention is to be limited only by the following claims and equivalents.

What is claimed is:

1. A pliers tool with adjustable jaws comprising, in combination:

a first handle including a handgrip extension at one end and a first handle hub at the other end opposite from the extension, said first handle hub including a center pivot and at least two first handle detents on one side of said first handle hub;

a second handle including a handgrip extension at one end and a second handle hub at the other end opposite from the second handle extension, said second handle hub also having a center pivot;

a first jaw having first and second sides and including a first jaw hub at one end and a first pincer extension at the opposite end, said first handle hub and said first handle detents opposed to the first side of the first jaw hub, said first jaw hub having a center pivot, a through passage with a detent ball therein for engaging one of the first handle detents and said first jaw hub further including a detent on the second side of the first jaw hub;

a second jaw including a second jaw hub at one end and a pincer extension at the opposite end, said second jaw hub opposed to the first jaw hub and having a center pivot, said second jaw hub including a detent in a side opposed to said detent in the second side of the first jaw hub;

said handles and jaws pivotally connected together by a pivot pin in the center pivots;

said jaws further including a biasing member interposed between the jaws for biasing the jaws apart about the center pivot, said detents and through passage all an equal radial distance from the center pivot whereby the first handle and second jaw may be pivoted with respect to each other to align the detent ball in the second jaw detent and release the ball from engagement with a detent in the first handle hub.

2. A pliers construction comprising, in combination:

a first handle;

a second handle;

a first jaw;

a second jaw;

each of said jaws and handles having a hub with a center pivot, said handles and jaws connected together by a pivot connection with the hubs overlying each other and rotatable about the pivot relative to the handles, said first handle and first jaw connectable together at their respective hubs to rotate about the pivot in unison, said second handle and second jaw connectable together at their respective hubs to rotate about the pivot in unison;

a mechanism for releasably connecting and disconnecting the respective hubs, said mechanism including a series of detents in each of the handle hubs at an equal radial distance from the pivot, a through passage in each jaw hub at said equal radial distance from the pivot with a detent ball therein for engagement in handle hub detents, said jaw hubs having planar surfaces positioned in opposed, contacting relationship and including detents in opposed jaw hub surfaces at an equal radial distance from the pivot, and a window in each jaw hub radially spaced from the pivot with a biasing member simultaneously biasing the jaws about the pivot to align the windows, whereby the first jaw and second handle or second jaw and first handle may be pivoted about the pivot toward one another to compress the biasing member, pivot one of the jaws and subsequently release the jaws from detent engagement with their respective handles.

3. The pliers construction of claim 2 wherein the window includes a compressible spring biasing member, said spring compressible by relative pivotal movement of the jaw hubs to engage the jaw hub windows with the spring to compress the spring and pivot one jaw hub to align said hub through passage with a detent in a handle and a detent in the next adjacent jaw hub to thereby permit rotation of said jaw relative to said handle and reorient said jaw relative to said handle by aligning the through passage of said jaw hub with another detent in the said handle.

4. A pliers having a separate handle member and separate jaw member, said pliers including an attachment mechanism for connecting the handle member to the jaw member which permits adjustment of the orientation of the handle member to the jaw member, said pliers comprising, in combination:

a first handle member including a hub with a center pivot;

a second handle member including a hub with a center pivot;

a first separate jaw member including a hub with a center pivot;

a second jaw member including a hub with a center pivot;

a pin member through the center pivots connecting the handle members and jaw members, said first handle member and said first jaw member connected by a first attachment mechanism to rotate in unison about the center pivot, said second handle member and said second jaw member connected by a second attachment mechanism to rotate in unison about the center pivot; said first attachment mechanism including at least two recess detents in the first handle member hub opposed to the first jaw member hub, said first jaw member hub including a through passage with a detent engaging member positioned in the through passage, said first jaw hub member opposed to the second jaw hub member, said second jaw hub member including a detent recess, said detent recesses and said through passage all being an equal radial distance from the center pivot, said detent engaging member positioned in the through passage and one of the first handle recesses to connect the first handle member and firstjaw member, said detent engaging member releasable upon rotation of the first jaw member about the center pivot to align the through passage with the detent recess of the second hub member whereby the first jaw member may be reoriented relative to the first handle member.

5. The pliers of claim 4 wherein the first and second jaws include end clamps and further including a spring member for biasing the end clamps away from each other.

6. The pliers of claim 4 including stop members on the handle members for limiting the spreading of the handle members about the pivot.

7. The pliers of claim 4 including a stop lug on the second handle member for limiting pivotal movement of the first jaw member.

* * * * *